US011278136B2

(12) United States Patent
Murphy

(10) Patent No.: US 11,278,136 B2
(45) Date of Patent: Mar. 22, 2022

(54) RESTORATIVE HEAD AND NECK PILLOW

(71) Applicant: Timothy Michael Murphy, Gaithersburg, MD (US)

(72) Inventor: Timothy Michael Murphy, Gaithersburg, MD (US)

( * ) Notice: Subject to any disclaimer, the term of this patent is extended or adjusted under 35 U.S.C. 154(b) by 0 days.

(21) Appl. No.: 16/796,314

(22) Filed: Feb. 20, 2020

(65) Prior Publication Data

US 2020/0268183 A1 Aug. 27, 2020

Related U.S. Application Data

(60) Provisional application No. 62/809,591, filed on Feb. 23, 2019.

(51) Int. Cl.
*A47G 9/10* (2006.01)

(52) U.S. Cl.
CPC ..... *A47G 9/109* (2013.01); *A47G 9/1054* (2013.01); *A47G 2009/1018* (2013.01)

(58) Field of Classification Search
CPC .... A47G 9/1054; A47G 9/1081; A47G 9/109; A47G 2009/1018; A47G 9/10; A47G 9/1063; A47G 9/1072; A47G 9/1018
See application file for complete search history.

(56) References Cited

U.S. PATENT DOCUMENTS

| | | | | |
|---|---|---|---|---|
| 2008/0092908 | A1* | 4/2008 | Costa | A47G 9/109 128/848 |
| 2013/0007961 | A1* | 1/2013 | Noh | A47G 9/1054 5/638 |
| 2015/0040322 | A1* | 2/2015 | Cheng | A47G 9/1054 5/638 |
| 2015/0089743 | A1* | 4/2015 | Haworth | A47G 9/1036 5/640 |
| 2015/0121626 | A1* | 5/2015 | Carver | A47G 9/1081 5/638 |
| 2017/0013978 | A1* | 1/2017 | Rosenberg | A47G 9/1081 |
| 2017/0128307 | A1* | 5/2017 | Kim | A61H 1/008 |
| 2018/0042409 | A1* | 2/2018 | Johnson | A61G 13/121 |
| 2018/0317678 | A1* | 11/2018 | Peric | A61G 7/072 |
| 2019/0069698 | A1* | 3/2019 | Lin | A47C 20/02 |

* cited by examiner

*Primary Examiner* — Peter M. Cuomo
*Assistant Examiner* — George Sun

(57) ABSTRACT

The present invention relates to head and neck pillows configured to provide proper support and advantageous positions of the head and neck for reducing spinal stress, maximizing air flow via the respiratory pathway and promoting healthy restorative sleep in a user. The head and neck pillow comprises an open head positioning support area, neck support areas when the user is resting in supine position. The invention further discloses a first side and a second side of the head and neck pillow comprising support areas for the side of the head and neck as well as curved transition surfaces for smooth transitioning of the head and neck of the user from supine or prone to side resting positions. In an embodiment, the invention discloses a head and neck pillow with an open head positioning area, a neck support area and a handle positioned adjacent to the open head positioning area.

13 Claims, 5 Drawing Sheets

RESTORATIVE HEAD AND NECK PILLOW

This application claims priority from the U.S. application No. 62/809,591 which is a provisional application filed on Feb. 23, 2019 titled 'STRESS REDUCING HEAD AND CERVICAL PILLOW' at the USPTO. The contents of the provisional application are included herein in its entirety by this reference thereto.

FIELD OF THE INVENTION

The present invention relates to pillows and, more particularly, to a restorative head and neck pillow that is geometrically configured in a manner to provide proper support, orientation and the most beneficial positions of the head and neck for reducing spinal stress, maximizing air flow via the respiratory pathway and promoting healthy restorative sleep in a user. It also relates to a contoured path that provides the support when the user transitions from side to supine and supine to side resting positions. It also relates to a contoured path that provides the support when the user transitions from side to prone and prone to side resting positions.

BACKGROUND OF THE INVENTION

Conventionally, pillows consists of a top and bottom surface sewn together at the perimeter edges to form an exterior casing which defines an interior cavity which holds stuffing or padding. The standard rectangular pillows have been in use for many years. However, these type of pillows suffer from serious drawbacks in that they provide relatively poor resting support to the user. The support that is provided is generally uneven and can result in serious discomfort and exacerbation of pre-existing injuries. Poor support during sleep can cause all kinds of body aches including but not limited to head ache, neck ache, and other muscular discomfort.

Further, there is a fundamental flaw with traditional resting or sleeping pillows. All previously available pillows do not support the head and neck in the most beneficial positions for minimizing stress, and maximizing air flow through the respiratory pathway. One conspicuous example is the unnecessary stress previous pillows place on the spine of back position sleepers. Previous pillows lift back sleeper's head up in a chin to chest position thereby distorting the neutral as well as the most stress free natural curve of the cervical spinal area. This poor alignment not only adds to stress, but also restricts the respiratory pathway. Another noticeable example is the extra stress previous pillows place on the spine of stomach position sleepers. Stomach resting positions cause the head to turn in a stressful position. Previous pillows force the stomach sleeper's turned head back further thereby exerting an additional stress to the cervical spinal area. The present invention reduces cervical stress and improves breathing for a healthier more restorative sleeping experience.

In addition, previous pillows are not designed to provide an ideal supportive contoured path that maintains favorable spinal alignment of the head and neck when a user transitions from right-side to supine to left-side resting positions or right-side to prone to left-side resting positions. Therefore, previous pillows do a poor job at positioning and supporting the head and cervical spine in a manner that is advantageous to minimizing stress and improved breathing. They do not provide the paramount positioning and support required for optimal stress reduction, improved breathing, and healthy restorative sleep. As such there is a continuing unmet need for an improved and restorative head and neck pillow which provides proper support, orientation and the most beneficial positions of the head and neck for reducing spinal stress, maximizing air flow via the respiratory pathway and promoting healthy restorative sleep in a user.

SUMMARY OF THE INVENTION

The present invention, disclosed and described herein, achieves the above mentioned objects by providing a restorative head and neck pillow which is geometrically configured in a manner that reduces stress, promotes healthy restorative sleep and improves breathing by supporting the head and neck in the most effective and beneficial positions.

The present invention discloses a restorative head and neck pillow comprising (i) an open head positioning support area positioned in the middle of the head and neck pillow; (ii) a first neck support area and a second neck support area positioned at the front and back of the open head positioning support area; (iii) a first side of the head and neck pillow wherein the first side comprises of curved transition surfaces, a first side head support area, a first side neck support area and a second side neck support area; and (iv) a second side of the head and neck pillow wherein the second side comprises of curved transition surfaces, a second side head support area, a third side neck support area and a fourth side neck support area. In an embodiment, the first side head support area of the first side and the second side head support area of the second side are positioned adjacently and at opposite sides of the open head positioning area. Further, the first side neck support area is adjacent to the first neck support area, the second side neck support area is adjacent to the second neck support area, the third side neck support area is adjacent to the first neck support area and the fourth side neck support area is adjacent to the second neck support area.

In an embodiment, the head and neck pillow comprises curved transition surfaces on the first side as well as the second side for supporting the head and the neck of the user when the user transitions from supine or prone to right or left side resting positions.

In a preferred embodiment, the second neck support area of the present invention is slightly more elevated than the first neck support area for providing different level of support to the user for the back of the neck. Further, the second side neck support area adjacent to the second neck support area is slightly more elevated than the first side neck support area adjacent to the first neck support area. Additionally, the fourth side neck support area adjacent to the second neck support area is slightly more elevated than the third side neck support area adjacent to the first neck support area for providing different level of support to the user for the side of the neck.

In another embodiment, the first side head support area and the second side head support area of the restorative head and neck pillow are configured with curved edges allowing the nose and the face area to protrude over the edges and with sunken areas for reducing pressure to the side of the nasal cavity. The invention further comprises two seams on either side of the first neck support area and the second neck support area.

In an embodiment, the head and neck pillow optionally comprises a removable foam core fixed in the middle of the head and neck pillow. The invention further optionally comprises a fabric covering, a separating zipper, and a zipper retaining box allowing removal of the head and neck pillow.

The invention further discloses a head and neck pillow comprising (i) an open head positioning support area positioned in the middle of the head and neck pillow; (ii) a handle and a neck support area positioned at the front and back of the open head positioning support area; (iii) a first side of the head and neck pillow wherein the first side comprises of curved transition surfaces, a first side head support area, and a first side neck support area; and (iv) a second side of the head and neck pillow wherein the second side comprises of curved transition surfaces, a second side head support area, and a second side neck support area. In an embodiment, the first side head support area of the first side and the second side head support area of the second side are positioned adjacently and at opposite sides of the open head positioning area and the first side neck support area of the first side is adjacent to the neck support area, and the second side neck support area of the second side is adjacent to the neck support area.

In an embodiment, the invention comprises curved transition surfaces on the first side and second side for supporting the head and neck of the user when the user transitions from supine or prone to right or left side resting positions. In another embodiment, the first side head support area and the second side head support area are configured with curved edges allowing the nose and the face area to protrude over the edges and with sunken areas for reducing pressure to the side of the nasal cavity. In yet another embodiment, the invention comprises a fabric cover with a handle for covering the head and neck pillow.

BRIEF DESCRIPTION OF THE DRAWING FIGURES

The figures depict embodiments of the present invention for the purposes of illustration only. A person skilled in the art will easily recognize from the following description that alternative embodiments of the invention illustrated herein may be employed without departing from the principles of the disclosure described herein.

DETAILED DESCRIPTION OF THE INVENTION

It should be noted that the description and figures merely illustrate the principles of the present subject matter. It should be appreciated by those skilled in the art that conception and specific embodiments disclosed may be readily utilized as a basis for modifying or designing other structures for carrying out the same purposes of the present subject matter. It should also be appreciated by those skilled in the art that various arrangements that, although not explicitly described or shown herein, embody the principles of the present subject matter and are included within its scope. Furthermore, all examples recited herein are principally intended expressly to be for pedagogical purposes to aid the reader in understanding the principles of the present subject matter and the concepts contributed by the inventor to furthering the art and are to be construed as being without limitation to such specifically recited examples and conditions. The novel features which are believed to be characteristic of the present subject matter, both as to its organization and method of operation, together with further objects and advantages will be better understood from the following description when considered in connection with the accompanying figures.

These and other advantages of the present subject matter would be described in greater detail with reference to the following figures. It should be noted that the description merely illustrates the principles of the present subject matter. It will thus be appreciated that those skilled in the art will be able to devise various arrangements that, although not explicitly described herein, embody the principles of the present subject matter and are included within its scope.

Figure 4:
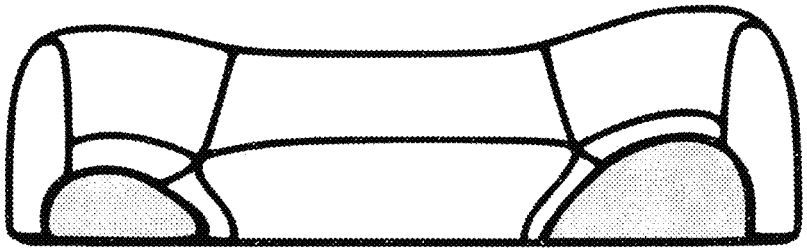
FIG. 4 illustrates a cross-section view of the restorative head and neck pillow, in accordance with an embodiment of the present invention.
Figure 5:
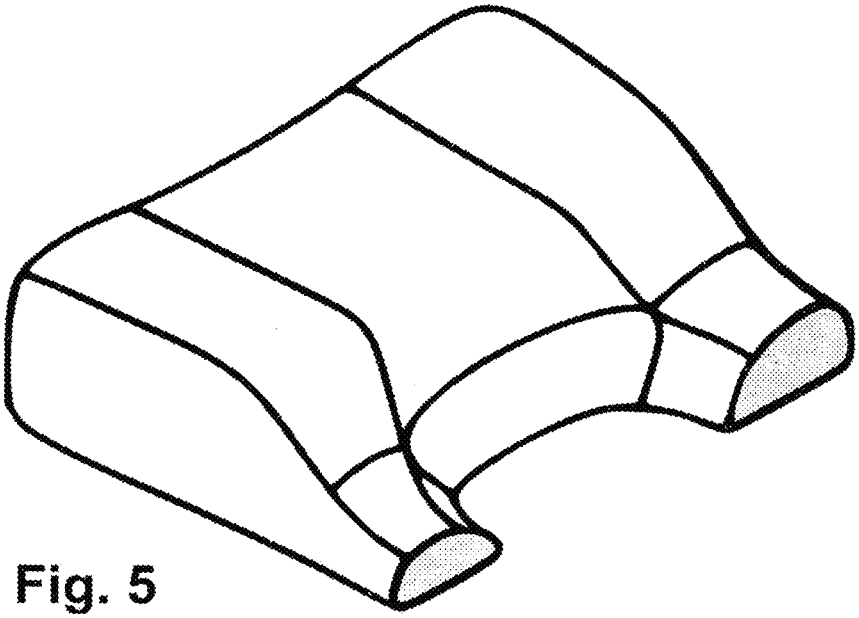
FIG. 5 illustrates a perspective cross-section view of the restorative head and neck pillow, in accordance with an embodiment of the present invention.
Figure 6:
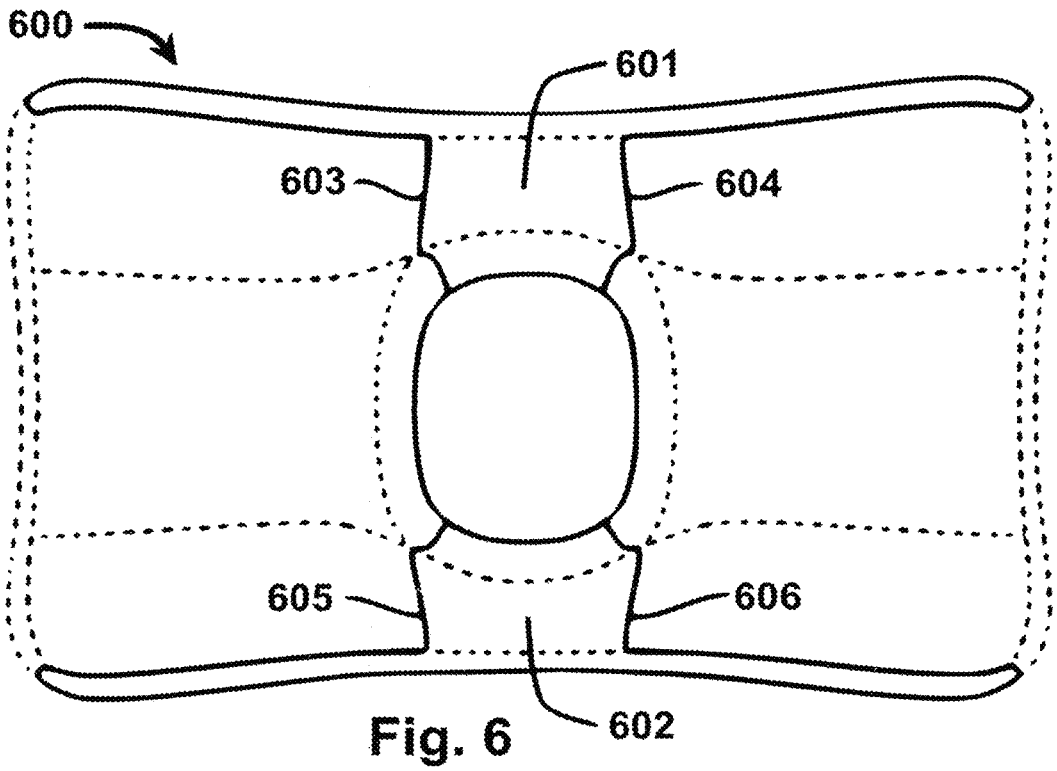
FIG. 6 illustrates a top view of the restorative head and neck pillow with fabric covering and seams, in accordance with an embodiment of the present invention.
Figure 7:
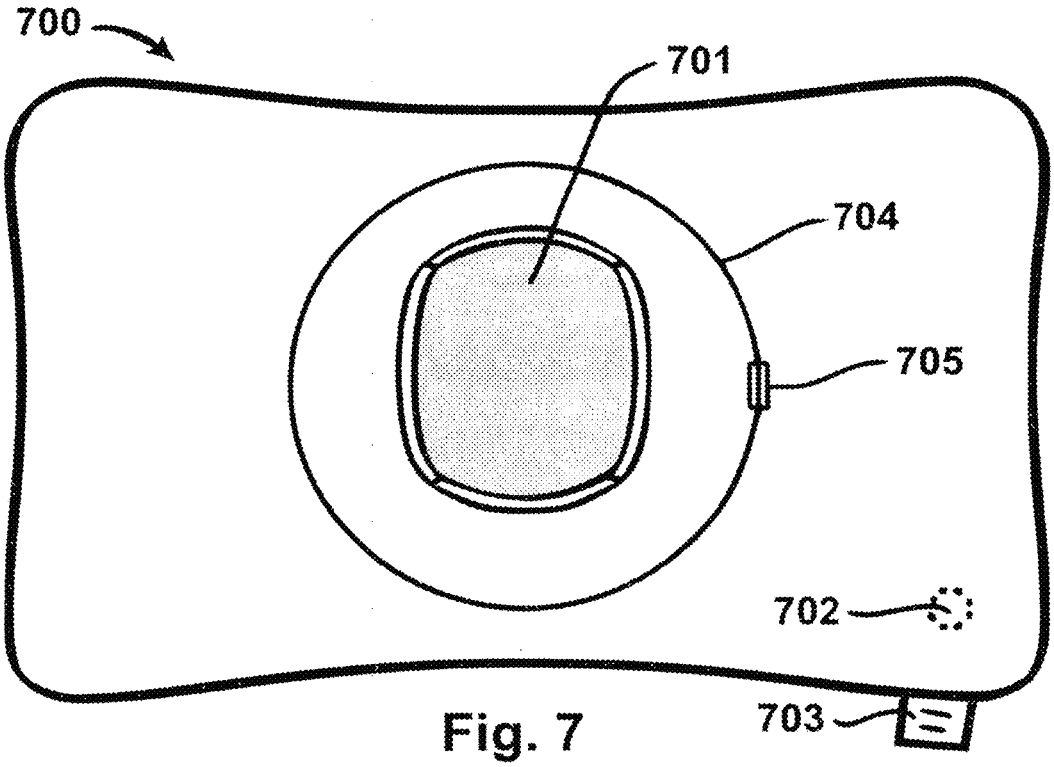
FIG. 7 illustrates a bottom view of the restorative head and neck pillow with registration mark, tag, separating zipper and zipper retainer box, in accordance with an embodiment of the present invention.
Figure 8:
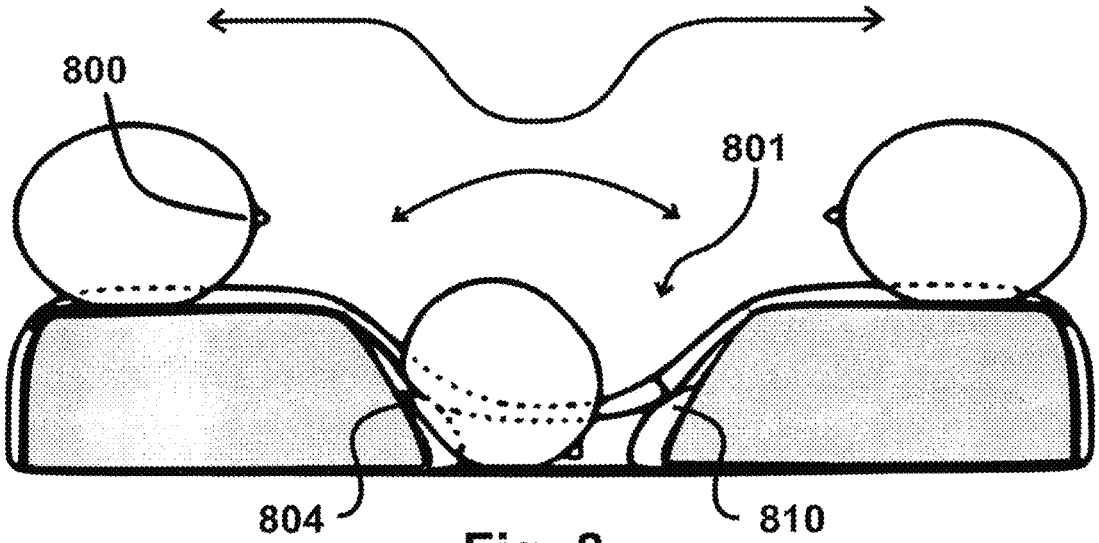
FIG. 8 illustrates a cross-section view of the restorative head and neck pillow, with head in prone and side positions, in accordance with an embodiment of the present invention.
Figure 9:
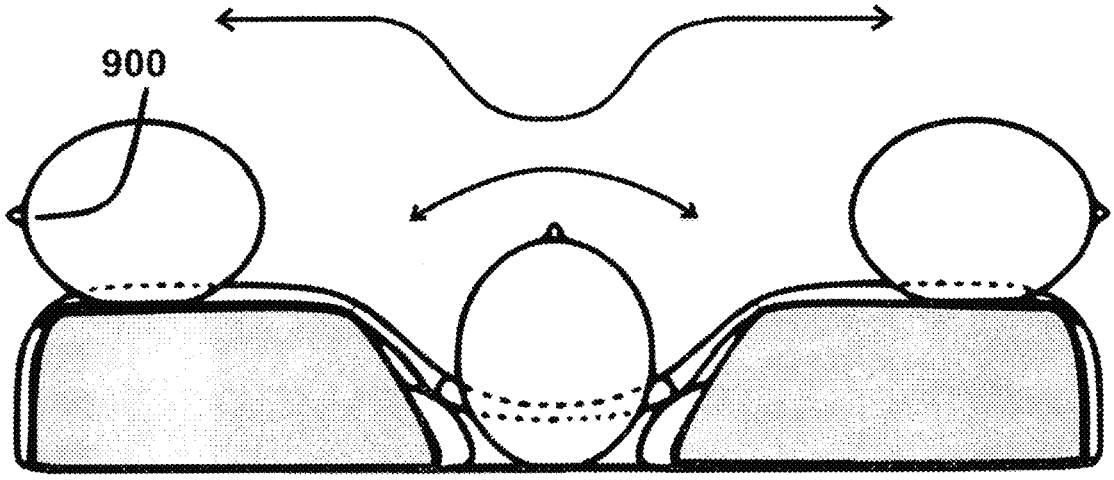
FIG. 9 illustrates a cross-section view of the restorative head and neck pillow, with head in supine and side positions, in accordance with an embodiment of the present invention.
Figure 10:
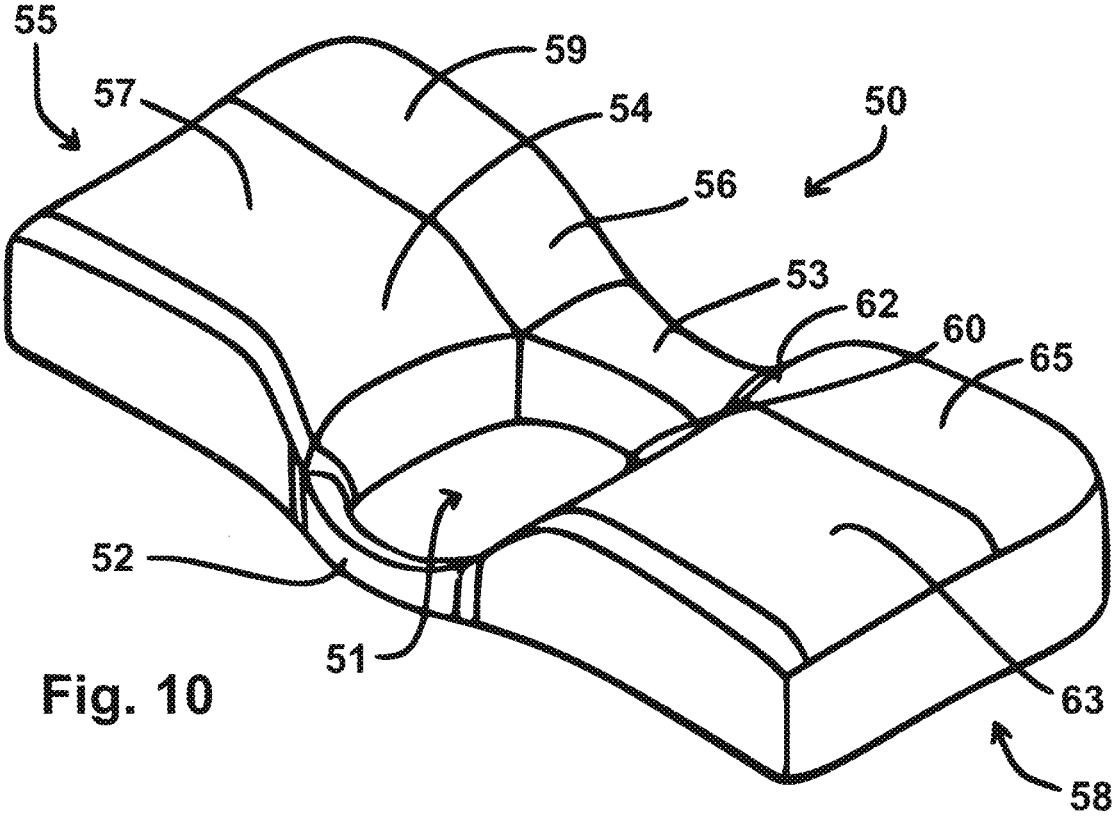
FIG. 10 illustrates a perspective view of the restorative head and neck pillow with a handle, in accordance with an embodiment of the present invention.
Figure 11:
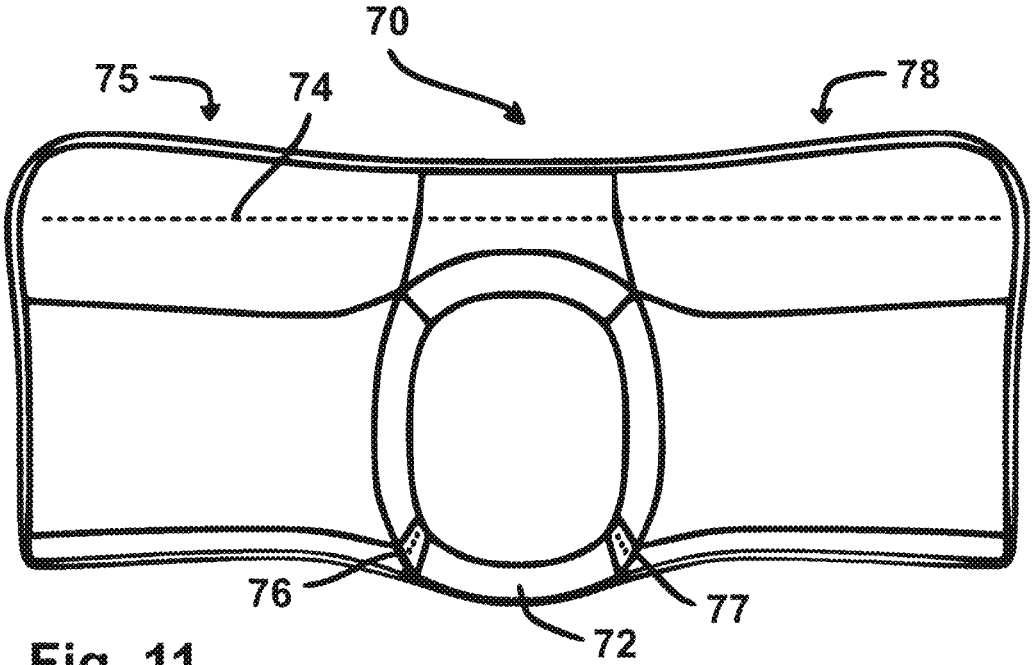
FIG. 11 illustrates a top view of the restorative head and neck pillow with a fabric cover containing a handle, in accordance with an embodiment of the present invention.

FIGS. 1 to 5 illustrate different views of the restorative head and neck pillow, in accordance with an embodiment of the present invention. FIGS. 4 and 5 illustrate cross-sectional views of the restorative head and neck pillow, in accordance with an embodiment of the present invention. FIG. 6 illustrates a top view of the restorative head and neck pillow with fabric covering and seams, in accordance with an embodiment of the present invention. FIG. 7 illustrates a bottom view of the restorative head and neck pillow with registration mark, tag, separating zipper and zipper retainer box, in accordance with an embodiment of the present invention. FIG. 8 illustrates a cross-section view of the restorative head and neck pillow, with head in prone and side positions, in accordance with an embodiment of the present invention. FIG. 9 illustrates a cross-section view of the restorative head and neck pillow, with head in supine and side positions, in accordance with an embodiment of the present invention. FIG. 10 illustrates a perspective view of the restorative head and neck pillow with a handle, in accordance with an embodiment of the present invention. FIG. 11 illustrates a top view of the restorative head and neck pillow with a handle and a fabric cover containing a handle, in accordance with an embodiment of the present invention.

Figure 1:
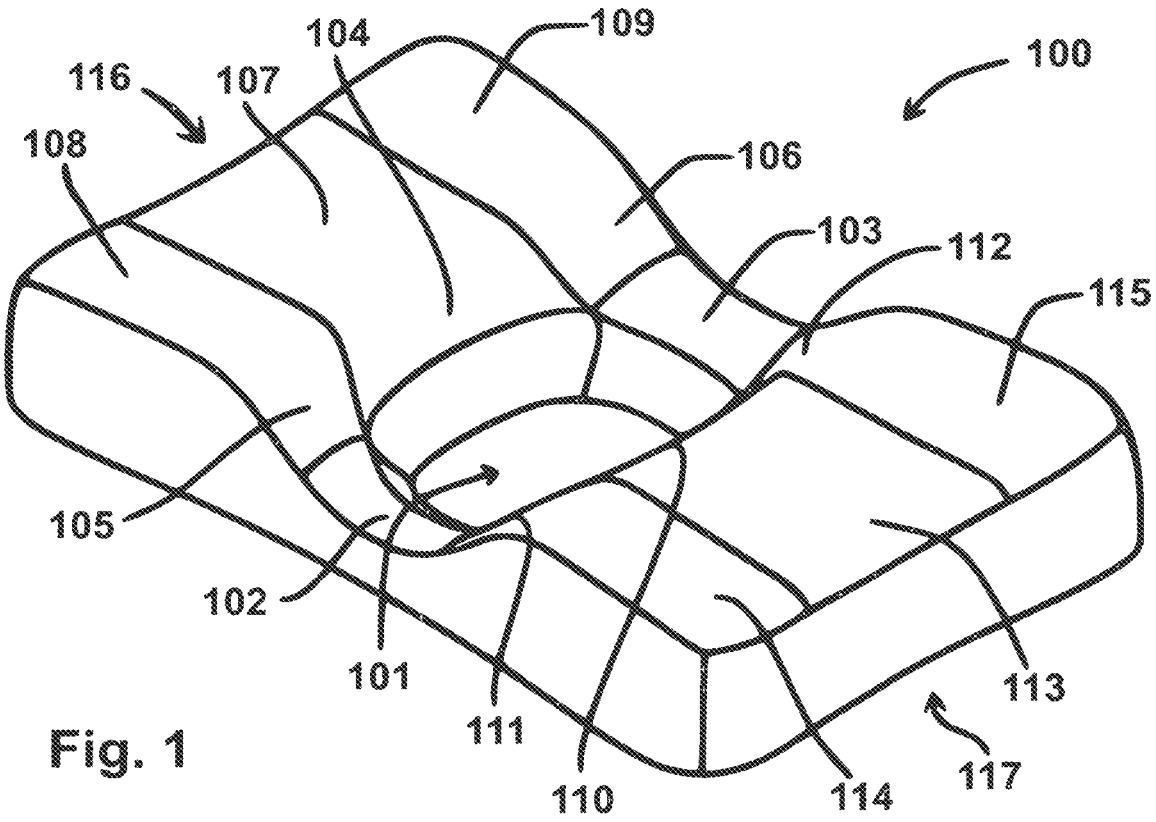
FIG. 1 illustrates a perspective view of the restorative head and neck pillow, in accordance with an embodiment of the present invention.
Figure 2:
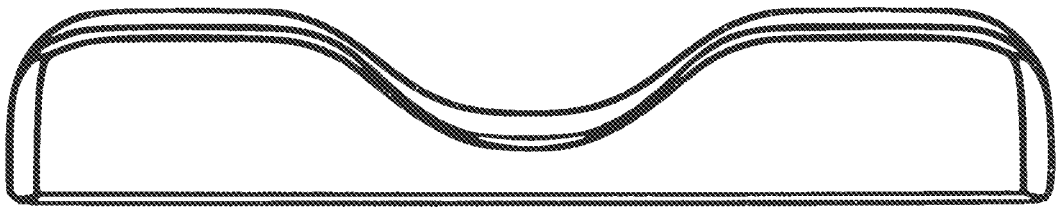
FIG. 2 illustrates a front view of the restorative head and neck pillow, in accordance with an embodiment of the present invention.
Figure 3:
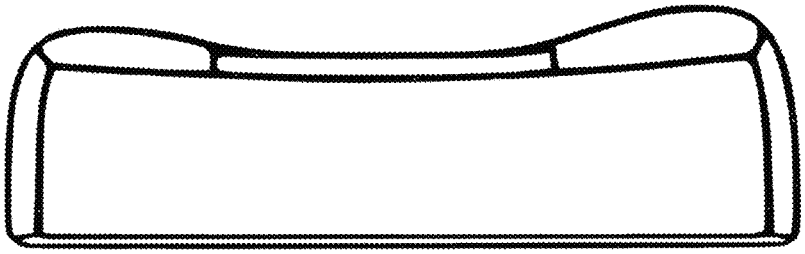
FIG. 3 illustrates a right side view of the restorative head and neck pillow, in accordance with an embodiment of the present invention.

Without limitation, a restorative head and neck pillow (100) is further described below in detail along with its geometrical configuration. FIG. 1 illustrates a perspective view of the restorative head and neck pillow (100), comprising of a first side (116), and a second side (117), in accordance with an embodiment of the present invention. The first side (116) of the restorative head and neck pillow (100) comprises of curved transition surfaces (104), (105) and (106), a first side head support area (107), a first side neck support area (108), and a second side neck support area (109). The second side (117) of the restorative head and neck pillow (100) comprises of curved transition surfaces (110), (111) and (112), a second side head support area (113), a third side neck support area (114), and a fourth side neck support area (115). In a preferred embodiment, the restorative head and neck pillow (100) is configured in a manner to provide an open head positioning support area (101) positioned in the middle of the pillow (100) along with a first neck support area (102) and a second neck support area (103) positioned adjacently at the front and back of the open head positioning support area (101). This configuration provides supine position sleepers with an open head positioning support area (101) that guides the back of the head of a user to a comfortable position which is in level with a bed. In this position, the bed supports the head and its connected body along a common plane. For supine position sleepers, the restorative head and neck pillow (100) further provides the first neck support area (102) and the second neck support area (103) which may be molded to the back of the neck's natural curve in a manner that provides stress reducing support and improves breathing culminating in restorative healthy sleep for the user.

FIG. 1 of the present invention further illustrates support areas for the head and neck when the user transitions from supine or prone to side resting positions. In an embodiment, when the user transitions from supine or prone to right or left side resting positions onto the first side (116), the restorative head and neck pillow (100) is configured to provide curved transition surfaces (104), (105) and (106) for smooth transitioning of the head and neck from supine or prone to right or left side resting positions and vice versa. As illustrated in FIG. 1, the curved transition surface (104) is located between the head positioning support area (101) and a first side head support area (107). The curved transition surface (105) is located between the first neck support area (102) and the first side neck support area (108) and the curved transition surface (106) is located between the second neck support area (103) and the second side neck support area (109). Illustratively, when the user transitions from supine to right side resting position onto the first side (116) of the pillow (100), the curved transition surface (105) is used for transitioning from the first neck support area (102) to the first side neck support area (108) and when the restorative head and neck pillow (100) is turned 180 degrees, it may be appreciated that for transitioning from supine to right side resting position onto the first side (116), the curved transition surface (106) is used instead of the curved transition surface (105) for transitioning from the second neck support area (103) to the second side neck support area (109).

In an embodiment, when the user transitions from supine or prone to left or right side resting positions onto the second side (117), the restorative head and neck pillow (100) is configured to provide the curved transition surfaces (110) (not seen in FIG. 1), (111) (not seen in FIG. 1), and (112) for smooth transitioning of the head and neck from supine or prone to right or left side resting positions and vice versa. As illustrated in FIG. 1, the curved transition surface (110) is located between the head positioning support area (101) and the second side head support area (113). The curved transition surface (111) is located between the first neck support area (102) and the third side neck support area (114) and the curved transition surface (112) is located between the second neck support area (103) and the fourth side neck support area (115). Illustratively, when the user transitions from supine to left side resting position onto the second side (117) of the pillow (100), the curved transition surface (111) is used for transitioning from the first neck support area (102) to the third side neck support area (114) and when the restorative head and neck pillow (100) is turned 180 degrees, it may be appreciated that for transitioning from supine to left side resting position onto the second side (117), the curved transition surface (112) is used instead of the curved transition surface (111) for transitioning from the second neck support area (103) to the fourth side neck support area (115).

In an embodiment, the curved transition surfaces (104), (105) and (106) follows the head and the neck along the turning path on the right side when the user transitions from supine or prone to right side resting position on the first side (116). Without limitation, the curved transition surfaces (110), (111) and (112), follows the head and neck along the turning path on the left side when the user transitions from supine or prone to left side resting position on the second side (117). The perpendicular distance between the user's turning axis which is located along either the right or left shoulder/hip sides to the spinal cord generally defines the boundary of said supportive curved transition surfaces thereby allowing the head to move naturally along a beneficially stress reducing curved path. This movement is considerably smoother and beneficial in the restorative head and neck pillow (100) disclosed herein than the previously available or known pillows which owing to its poor geometry is unable to achieve the same movement. Due to the poor geometry of the known pillows, during the supine position resting the pillow causes the head to tilt forward and when the user turns from supine to a side resting position, the head either moves back and forth or retains a more stressful and air restrictive forward tilt position. Right to supine to left side transitioning and vice versa is considerably improved by the present invention's curved transition surfaces.

The present invention further discloses the configuration of side resting positions for the user. In an embodiment, when the user is resting in a right side position on the first side (116), the head is conveniently supported by the first side head support area (107) and the neck is appropriately supported by (i) the first side neck support area (108) adjacent to the first neck support area (102), and (ii) the second side neck support area (109) adjacent to the second neck support area (103). In an embodiment, when the user is resting in a left side position on the second side (117), the head is conveniently supported by the second side head support area (113) and the neck is appropriately supported by (i) the third side neck support area (114) adjacent to the first neck support area (102) and (ii) the fourth side neck support area (115) adjacent to the second neck support area (103). FIG. 1 illustrates that the first side head support area (107) and the second side head support area (113) are positioned adjacently and at opposite sides of the open head positioning area (101). The support pressure is therefore evenly distributed between the head and the neck to a level that provides optimal alignment of the spine, thereby reducing stress and promoting healthy restorative sleep.

In a preferred embodiment, FIGS. 1 to 5 of the present invention discloses two levels of support for the back of the neck as well as for the sides of the neck. In an embodiment, the user simply turns the invention 180 degrees to obtain the desired level of support. Specifically, the invention has different geometrical configuration for providing different levels of support for the back and sides of the neck. FIG. 1 illustrates that the second neck support area (103) is slightly more elevated than the first neck support area (102) for providing different level of support to the user for the back of the neck. The user has the discretion and can opt to simply turn the pillow to 180 degrees to change the desired level of support for the back of the neck, for example, from the first neck support area (102) to the second neck support area (103). FIGS. 2 to 5 further illustrate that the second side neck support area (109) adjacent to the second neck support area (103) is slightly more elevated than the first side neck support area (108) adjacent to the first neck support area (102) and the fourth side neck support area (115) adjacent to the second neck support area (103) is slightly more elevated than the third side neck support area (114) adjacent to the first neck support area (102) for providing different level of support to the user for the side of the neck. The user has the discretion and can simply opt to turn the pillow 180 degrees to change the desired level of support for the sides of the neck, for example, in FIG. 1 the desired level of support can be changed from the first side neck support area (108) and the third side neck support area (114) to the second side neck support area (109) and the fourth side neck support area (115).

In an embodiment, FIGS. 1, 3, 4 and 5, illustrate that the first side head support area (107) and the second side head support area (113) are configured with curved edges and sunken areas. The sunken areas in the first side head support area (107) and the second side head support area (113) reduces pressure to the side of the nasal cavity and the curved edges allow the nose and the face area to protrude over the edges. These two exemplary embodiments help side sleepers breathe better. Further, by reducing the pressure to the eye socket and nasal cavity area, the user advantageously experiences reduced wrinkling of the facial skin. In yet another embodiment, FIGS. 1 and 6 illustrate that the restorative head and neck pillow (100) is configured in a manner that the curved edges of the front or back of the pillow (100) are generally shaped to follow the shoulder line and maintain maximum neck support area while turning. In the absence of the said curved edges, after turning from supine position to side position, part of the neck to the shoulder of the user loses contact with the pillow and some support is lost thereby causing inconvenience and leading to disruptions in sleep.

FIG. 6 also illustrates a restorative head and neck pillow (600) with fabric cover and seams. In an embodiment, to avoid irritation at the back of the neck with a single seam down the middle of the back of the neck area, the restorative head and neck pillow (600) uses two seams on either side of the first neck support area (601) and the second neck support area (602). The seams (603) and (604) are present on the side of the first neck support area (601). The seams (605) and (606) are present on the side of the second neck support area (602).

In an exemplary embodiment, FIG. 7 illustrates a bottom view of the restorative head and neck pillow (700) with a removable foam core (701) fixed in the middle of the restorative head and neck pillow (700) thereby filling the open head positioning support area and raising the position of the head slightly higher to provide a different level of support to the head of the user. Although it is not the ideal position for a neutral cervical curve and may not provide for the same level of comfort and support for the head but still some users may prefer this option instead of the restorative head and neck pillow (100) disclosed in FIG. 1 of the present specification. The removable foam core (701) may also help users transition from a traditional pillow to the invention as disclosed in the FIGS. 1 to 6 of the present invention. After using the restorative head and neck pillow (700) for a period of time, the user may remove the said foam core (701) to fully transition to the more favorable and beneficial alignment positions for the head as disclosed in FIGS. 1 to 6 of the present invention. The restorative head and neck pillow (700) is symmetrical from side to side, but not front to back. Because of this lack of symmetry, the restorative head and neck pillow (700) includes a registration mark (702) on the bottom side corner of the pillow (700) and the fabric cover includes a label or tag (703). By lining the label or tag (703) of the fabric cover with the registration mark (702), the fabric cover will be properly oriented with the restorative head and neck pillow (700). Due to the torus shaped restorative head and neck pillow (700), in order to create a removable cover for cleaning, the pillow cover uses a generally circular separating zipper (704) located on the bottom of the pillow. FIG. 7 illustrates a possible location for a zipper retainer box (705) which is the location for separating the zipper, thus allowing removal of the restorative head and neck pillow (700).

Many doctors and chiropractors claim supine resting is the most favorable position for reducing spinal stress, and side resting is the next best position. They also recommend avoiding stomach resting because this position adds excessive stress to the spine due to the extreme head turn angle. That being said, stress from stomach resting can be reduced by placing the side of the head with face pointing towards the bed on the right or left end of said invention or by placing the right or left side of the head with face pointing towards the bed on the funnel surface. These positions support and limit the skull's turn angle and attenuate to some degree the stress to the spine caused by the more extreme stomach resting head turn angle. FIG. 8 illustrates an embodiment with a user resting in prone and side resting positions. The figure illustrates the orientation of a user's face (800) as it transitions from prone and side resting positions. The open head positioning support area (801), and the curved transition surfaces (804) and (810) support and limit the head turn range of the user in the prone position. By supporting and limiting prone position head turn range, the overall stress on the neck of the user is considerably reduced. The open head positioning support area (801) also provides sufficient for the user to breathe, and further provides enough area for the prone sleeper to turn the head from one side to the other side.

When resting in supine position, the open head positioning support area (101) in FIG. 1 allows sensible head movement but resists extreme turning thereby providing comfort of movement and air flow around the head while still protecting against unreasonable stress to the cervical spine. FIG. 9 illustrates transitioning from side to supine resting positions, showing a user's face (900) pointing away from the pillow.

In an exemplary embodiment, FIG. 10 illustrates a perspective view of the restorative head and neck pillow (50) comprising of a first side (55) and a second side (58) in accordance with an embodiment of the present invention. The first side (55) of the restorative head and neck pillow (50) comprises of curved transition surfaces (54) and (56), a first side head support area (57), and a first side neck support area (59). The second side (58) of the restorative head and neck pillow (50) comprises of curved transition surfaces (60) and (62), a second side head support area (63), and a second side neck support area (65). In a preferred embodiment, the restorative head and neck pillow (50) is configured in a manner to provide an open head positioning support area (51) positioned in the middle of the pillow (50) along with a handle (52) and a neck support area (53) positioned at the front and back of the open head positioning support area (51) for supporting the neck of the user. This configuration provides supine position sleepers with an open head positioning support area (51) that guides the back of the head of a user to a comfortable position which is in level with a bed. In this position, the bed supports the head and its connected body along a common plane. For supine position sleepers, the restorative head and neck pillow (50) further provides the neck support area (53) which may be molded to the back of the neck's natural curve in a manner that provides stress reducing support and improves breathing culminating in restorative healthy sleep for the user.

FIG. 10 of the present invention further illustrates support areas for the head and neck when the user transitions from supine or prone to side resting positions. In an embodiment, when the user transitions from supine or prone to right or left side resting positions onto the first side (55), the restorative head and neck pillow (50) is configured to provide the curved transition surfaces (54) and (56) for smooth transitioning of the head and neck from supine or prone to right or left side resting positions and vice versa. As illustrated in FIG. 10, the curved transition surface (54) is located between the head positioning support area (51) and the first side head support area (57). The curved transition surface (56) is located between the neck support area (53) and the first side neck support area (59). Illustratively, when the user transitions from supine to right side resting position onto the first side (55), the curved transition surface (56) is used for transitioning from the neck support area (53) to the first side neck support area (59). In an embodiment, when the user transitions from supine or prone to left or right side resting positions onto the second side (58), the restorative head and neck pillow (50) is configured to provide the curved transition surfaces (60) (not seen in FIG. 10) and (62) for smooth transitioning of the head and neck from supine or prone to right or left side resting positions and vice versa. As illustrated in FIG. 10, the curved transition surface (60) is located between the head positioning support area (51) and the second side head support area (63). The curved transition surface (62) is located between the neck support area (53) and the second side neck support area (65). Illustratively, when the user transitions from supine to left side resting position onto the second side (58), the curved transition surface (62) is used for transitioning from the neck support area (53) to the second side neck support area (65).

In an embodiment, the curved transition surfaces (54) and (56) follow the head and the neck along the turning path on the right side when the user transitions from supine or prone to right side resting position on the first side (55). Without limitation, the curved transition surfaces (60) and (62) follows the head and neck along the turning path on the left side when the user transitions from supine or prone to left side resting position on the second side (58). The perpendicular distance between the user's turning axis which is located along either the right or left shoulder/hip sides to the spinal cord generally defines the boundary of said supportive curved transition surfaces thereby allowing the head to move naturally along a beneficially stress reducing curved path. This movement is considerably smoother and beneficial in the restorative head and neck pillow (50) disclosed herein than the previously available or known pillows which owing to its poor geometry is unable to achieve the same movement. Due to the poor geometry of the known pillows, during the supine position resting the pillow causes the head to tilt forward and when the user turns from supine to a side resting position, the head either moves back and forth or retains a more stressful and air restrictive forward tilt position. Right to supine to left side and vice versa transitioning is considerably improved by the present invention's curved transition surfaces.

The present invention further discloses the configuration of side resting positions for the user. In an embodiment, when the user is resting in a right side position on the first side (55), the head is conveniently supported by the first side head support area (57) and the neck is appropriately supported by the first side neck support area (59) adjacent to the neck support area (53). In an embodiment, when the user is resting in a left side position on the second side (58), the head is conveniently supported by the second side head support area (63) and the neck is appropriately supported by the second side neck support area (65) adjacent to the neck support area (53). The support pressure is evenly distributed between the head and the neck to a level that provides optimal alignment of the spine, thereby reducing stress and promoting healthy restorative sleep. Although the restorative head and neck pillow (50) has less neck supporting areas than the restorative head and neck pillow (100) illustrated in FIG. 1, it is a smaller, compact, and more portable pillow which can be carried by the user while travelling and the user can also enjoy its' previously stated benefits. It should be appreciated by those skilled in the art that the handle (52) provides structural integrity by restricting the first side (55) and the second side (58) from parting, collapsing or distorting.

In an exemplary embodiment, FIG. 11 illustrates a top view of a restorative head and neck pillow (70) with a fabric cover containing a handle (72) comprising of a first side (75) and a second side (78) in accordance with an embodiment of the present invention. The fabric cover containing the handle (72) has an opening (74) located on the bottom side of the restorative head and neck pillow (70). The opening (74) may be closed using buttons, zipper, Velcro, string or other types of fasteners. It should be appreciated that fastening the opening (74) is not required to hold the fabric cover containing the handle (72) to the restorative head and neck pillow (70). The handle (72) releases from the restorative head and neck pillow (70) at separation points (76) and (77). It should be appreciated by those skilled in the art that the fabric cover containing the handle (72) provides structural integrity by restricting the first side (75) and the second side (78) from parting, collapsing or distorting.

A person having ordinary skill in the art can fashion said invention out of various materials. For example, an airtight fabric shell can be used to fashion an air pillow. Different types of foam can be used such as polyurethane or visco-elastic (memory foam). Use of cooling gels or other such materials may add value to the pillow. Various types of feathers, cotton, synthetic fibers, water etc. may also be used for the construction of the said invention.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further appreciated that functions or structures of a plurality of components or steps may be combined into a single component or step, or the functions or structures of one-step or component may be split among plural steps or components. The present invention contemplates all of these combinations. Unless stated otherwise, dimensions and geometries of the various portions depicted herein are not intended to be restrictive of the invention, and other dimensions or geometries are possible. In addition, while a feature of the present invention may have been described in the context of only one of the illustrated embodiments, such feature may be combined with one or more other features of other embodiments, for any given application. The use of "comprising" or "including" also contemplates embodiments that "consist essentially of" or "consist of" the recited feature.

Although embodiments for the present invention have been described in language specific to structural features, it is to be understood that the present invention is not necessarily limited to the specific features described. Rather, the specific features are disclosed as embodiments for the present subject matter. Numerous modifications and adaptations of the system/component of the present invention will be apparent to those skilled in the art, and thus it is intended by the appended claims to cover all such modifications and adaptations which fall within the scope of the present subject matter.

I claim:

1. A head and neck pillow (100) comprising:

an open head positioning support area (101) positioned in the middle of the head and neck pillow (100) wherein the open head positioning support area (101) is configured to guide the back of the head of a user to rest on a bed;

a first neck support area (102) and a second neck support area (103) positioned at the front and back of the open head positioning support area (101) wherein the second neck support area (103) is slightly more elevated and wider than the first neck support area (102);

a first side (116) of the head and neck pillow (100) wherein the first side (116) comprises of a first curved head transition surface (104), a first curved neck transition surface (105) and a second curved neck transition surface (106), a first side head support area (107), a first side neck support area (108) and a second side neck support area (109) further wherein the second side neck support area (109) adjacent to the second curved neck transition surface (106) is slightly more elevated and wider than the first side neck support area (108) adjacent to the first curved neck transition surface (105) further wherein the first curved neck transition surface (105) and the second curved neck transition surface (106) protrude beyond the first curved head surface (104) further wherein the second curved neck transition surface (106) protrudes more than the first curved neck transition surface (105) from the first curved head transition surface (104);

a second side (117) of the head and neck pillow (100) wherein the second side (117) comprises of a second curved head transition surface (110), a third curved neck transition surface (111) and a fourth curved neck transition surface (112), a second side head support area (113), a third side neck support area (114) and a fourth side neck support area (115) further wherein the fourth side neck support area (115) adjacent to the fourth curved neck transition surface (112) is slightly more elevated and wider than the third side neck support area (114) adjacent to the third curved neck transition surface (111) further wherein the third curved neck transition surface (111) and the fourth curved neck transition surface (112) protrude beyond the second curved head transition surface (110) further wherein the fourth curved neck transition surface (112) protrudes more than the third curved neck transition surface (111) from the second curved head transition surface (110); and wherein the first side head support area (107) and the second side head support area (113) comprise of curved outer edges and sunken area at the outer edges.

2. The head and neck pillow (100) as claimed in claim 1, wherein the first side head support area (107) of the first side (116) and the second side head support area (113) of the second side (117) are positioned adjacently and at opposite sides of the open head positioning support area (101).

3. The head and neck pillow (100) as claimed in claim 1, wherein the first side neck support area (108) is adjacent to the first neck support area (102), the second side neck support area (109) is adjacent to the second neck support area (103), the third side neck support area (114) is adjacent to the first neck support area (102) and the fourth side neck support area (115) is adjacent to the second neck support area (103).

4. The head and neck pillow (100) as claimed in claim 1, wherein the first curved head transition surface (104) on the first side (116) and the second curved head transition surface (110) on the second side (117) supports a user's head when the user transitions from supine or prone to right or left side resting positions.

5. The head and neck pillow (100) as claimed in claim 1, wherein the first curved neck transition surface (105) and the second curved neck transition surface (106) on the first side (116) and the third curved neck transition surface (111), and the fourth curved neck transition surface (112) on the second side (117) supports the user's neck when the user transitions from supine or prone to right or left side resting positions.

6. The head and neck pillow (100) as claimed in claim 1, comprising a removable foam core fixed in the middle of the head and neck pillow.

7. The head and neck pillow (100) as claimed in claim 1, comprising a fabric cover, a separating zipper and a zipper retaining box allowing removal of the head and neck pillow (100).

8. A head and neck pillow (50) comprising:

an open head positioning support area (51) positioned in the middle of the head and neck pillow (50) wherein the open head positioning support area (51) is configured to guide the back of the head of a user to rest on a bed;

a handle (52) and a neck support area (53) positioned at the front and back of the open head positioning support area (51);

a first side (55) of the head and neck pillow (50) wherein the first side (55) comprises of a first curved head transition surface (54) and a first curved neck transition surface (56), a first side head support area (57), and a first side neck support area (59) further wherein the first curved neck transition surface (56) protrudes beyond the first curved head transition surface (54);

a second side (58) of the head and neck pillow (50) wherein the second side (58) comprises of a second curved head transition surface (60) and a second curved neck transition surface (62), a second side head support area (63), and a second side neck support area (65) further wherein the second curved neck transition surface (62) protrudes beyond the second curved head transition surface (60); and wherein the first side head support area (57) and the second side head support area (63) comprise of curved outer edges and sunken area at the outer edges.

9. The head and neck pillow (50) as claimed in claim 8, wherein the first side head support area (57) of the first side (55) and the second side head support area (63) of the second side (58) are positioned adjacently and at opposite sides of the open head positioning support area (51).

10. The head and neck pillow (50) as claimed in claim 8, wherein the first side neck support area (59) of the first side (55) is adjacent to the first curved neck transition surface (56), and the second side neck support area (65) of the second side (58) is adjacent to the second curved neck transition surface (62).

11. The head and neck pillow (50) as claimed in claim 8, wherein the first curved head transition surface (54) on the first side (55) and the second curved head transition surface (60) on the second side (58) supports the user's head when the user transitions from supine or prone to right or left side resting positions.

12. The head and neck pillow (50) as claimed in claim 8, wherein the first curved neck transition surface (56) on the first side (55) and the second curved neck transition surface (62) on the second side (58) supports the user's neck when the user transitions from supine or prone to right or left side resting positions.

13. The head and neck pillow (50) as claimed in claim 8, comprising a fabric cover with a handle for covering the head and neck pillow (50).

* * * * *